US010652669B2

(12) United States Patent
Tiefenau et al.

(10) Patent No.: US 10,652,669 B2
(45) Date of Patent: May 12, 2020

(54) RECEIVER ASSEMBLY HAVING A DISTINCT LONGITUDINAL DIRECTION

(71) Applicant: Sonion Nederland B.V., Hoofddorp (NL)

(72) Inventors: Andreas Tiefenau, Hoofddorp (NL); Laurens de Ruijter, Hoofddorp (NL); Nicolaas Maria Jozef Stoffels, Hoofddorp (NL)

(73) Assignee: SONION NEDERLAND B.V., Hoofddorp (NL)

( * ) Notice: Subject to any disclaimer, the term of this patent is extended or adjusted under 35 U.S.C. 154(b) by 0 days.

(21) Appl. No.: 16/365,260

(22) Filed: Mar. 26, 2019

(65) Prior Publication Data

US 2019/0289407 A1 Sep. 19, 2019

Related U.S. Application Data

(63) Continuation of application No. 15/384,775, filed on Dec. 20, 2016, now abandoned.

(30) Foreign Application Priority Data

Dec. 21, 2015 (EP) ..... 15201509

(51) Int. Cl.
*H04R 25/00* (2006.01)

(52) U.S. Cl.
CPC ..... *H04R 25/48* (2013.01); *H04R 25/604* (2013.01); *H04R 25/456* (2013.01); *H04R 2201/003* (2013.01); *H04R 2225/023* (2013.01); *H04R 2225/025* (2013.01)

(58) Field of Classification Search
CPC .... H04R 25/48; H04R 25/604; H04R 25/456; H04R 2201/003; H04R 225/023; H04R 2225/025
See application file for complete search history.

(56) References Cited

U.S. PATENT DOCUMENTS

| | | | |
|---|---|---|---|
| 3,812,300 | A | 5/1974 | Brander |
| 6,788,796 | B1 | 9/2004 | Miles |
| 6,831,577 | B1 | 12/2004 | Furst |

(Continued)

FOREIGN PATENT DOCUMENTS

| | | | |
|---|---|---|---|
| EP | 2160047 | A2 | 3/2010 |
| EP | 2166779 | A2 | 3/2010 |

(Continued)

OTHER PUBLICATIONS

Extended European Search Report in European Patent Application No. EP 18203463.7, dated Feb. 25, 2019 (3 pages).

(Continued)

*Primary Examiner* — Sunita A Joshi
(74) *Attorney, Agent, or Firm* — Nixon Peabody LLP

(57) ABSTRACT

The present invention relates to a receiver assembly comprising a first receiver having a distinct longitudinal direction and a first longitudinal centre line, and a second receiver having a distinct longitudinal direction and a second longitudinal centre line, wherein the distinct longitudinal directions of the first and second receivers are arranged essentially along a distinct longitudinal direction of the receiver assembly. The receiver assembly further comprises one or more microphone units.

19 Claims, 8 Drawing Sheets

(56) References Cited

U.S. PATENT DOCUMENTS

| | | | |
|---|---|---|---|
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doom |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 2010/0067730 | A1 | 3/2010 | van Halteren |
| 2010/0128905 | A1* | 5/2010 | Warren ..... H04R 1/1016 381/312 |
| 2011/0182453 | A1 | 7/2011 | van Hal |
| 2011/0189880 | A1 | 8/2011 | Bondo |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0189149 | A1* | 7/2012 | Finlay ..... H04R 25/00 381/328 |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0182877 | A1* | 7/2013 | Angst ..... H04R 1/227 381/328 |
| 2013/0195295 | A1 | 8/2013 | van Halteren |
| 2014/0305735 | A1 | 10/2014 | van Halteren |
| 2016/0165361 | A1 | 6/2016 | Miller et al. |

FOREIGN PATENT DOCUMENTS

| | | | |
|---|---|---|---|
| EP | 2733956 | A2 | 5/2014 |
| WO | 2010116006 | A2 | 10/2010 |
| WO | 2011046508 | A1 | 4/2011 |
| WO | 2015050446 | A1 | 4/2015 |

OTHER PUBLICATIONS

European Search Report for European Patent Application No. EP 15201509.2, dated Jun. 1, 2016 (3 pages).

* cited by examiner

RECEIVER ASSEMBLY HAVING A DISTINCT LONGITUDINAL DIRECTION

CROSS-REFERENCE TO RELATED APPLICATION

This application claims the benefit of European Patent Application Serial No. 15201509.5, filed Dec. 21, 2015, which is incorporated herein by reference in its entirety.

FIELD OF THE INVENTION

The present invention relates to a receiver assembly for hearing devices. In particular the present invention relates to a receiver assembly having a distinct longitudinal direction and a reduced thickness and/or width in order to fit into the ear canal of a human being.

BACKGROUND OF THE INVENTION

Various receiver assemblies for hearing devices, such as hearing aids, have been suggested over the years.

As an example US 2012/0255805 A1 discloses a receiver assembly comprising two spatially shifted receivers in the form of a first U-shaped armature and a second U-shaped armature. The two receivers are spatially shifting in a longitudinal direction of the receiver assembly with the purpose of suppressing vibrations. However, as the two receivers of the assembly suggested in the US 2012/0255805 A1 are not arranged in-line, i.e. in continuation of each other, the overall height of the assembly might be problematic in relation to a receiver-in-canal (MC) hearing aid. Thus, there seems to be a need for hearing aid receiver assemblies, in particular MC assemblies, with a reduced height so as to fit into the human ear canal.

It may be seen as an object of embodiments of the present invention to provide a receiver assembly having a distinct longitudinal direction.

It may be seen as a further object of embodiments of the present invention to provide a receiver assembly that, to a large degree, follows the shape of an ear canal of a human being.

It may be seen as a still further object of embodiments of the present invention to provide a receiver assembly being suitable for hearing devices.

SUMMARY OF INVENTION

The above-mentioned objects are complied with by providing, in a first aspect, a receiver assembly comprising a first receiver having a distinct longitudinal direction and a first longitudinal centre line, a second receiver having a distinct longitudinal direction and a second longitudinal centre line, and one or more microphone units for receiving incoming sound, wherein the distinct longitudinal directions of the first and second receivers are arranged essentially along a distinct longitudinal direction of the receiver assembly, and wherein the first receiver, the second receiver and the one or more microphone units are at least partly arranged within an assembly housing.

It is advantageous that the receiver assembly of the present invention has a distinct longitudinal direction, and thereby a distinct longitudinal shape, so that it fits into a typical ear canal of the human being. By distinct longitudinal shape is meant that the receiver assembly is significantly longer compared to its height and width.

The distinct longitudinal shape of the receiver assembly may be provided in various ways. For example, the first and second receivers may be arranged with essentially parallel first and second longitudinal centre lines. Longitudinal centre lines are here to be considered as virtual lines extending in the respective distinct longitudinal directions of each of the first and second receivers.

In one embodiment the first and second receivers may be spatially shifted in a direction being essentially perpendicular to first and second longitudinal centre lines. Thus, the first and second receivers may be spatially shifted in the height and/or width direction of the receivers. The spatial shifting of the receivers may amount up to around 50% of the height and/or width of the smallest receiver, in case the sizes of the two receivers are different.

In another embodiment the first and second receivers may be arranged in an in-line configuration with essentially coinciding first and second longitudinal centre lines. In this embodiment the two receivers are arrangement in connection of each other.

Each of the first and second receivers has a primary moving direction which may be defined as the direction of movement of a membrane. When incorporated into the receiver assembly of the present invention the first and second receivers may be arranged with their respective moving directions in essentially opposite directions in order to reduce vibrations. Alternatively, the first and second receivers may be arranged with their respective moving directions in essentially parallel directions.

In yet another embodiment the first and second receivers may be arranged with angled first and second longitudinal centre lines. Thus, in this embodiment the first and second receivers are arranged relative to each other. This may be advantageous in that the receiver assembly may then follow a human ear canal even more effective. According to this embodiment the first and second receivers may be arranged with an angle of 5-45 degrees, such as 5-40 degrees, such as 5-35 degrees, such as 5-30 degrees, such as 5-25 degrees, such as 5-20 degrees, such as 5-15 degrees, such as 5-10 degrees, between the first and second longitudinal centre lines.

The first and second receivers may be connected in various ways. One approach may be to connect the first and second receivers via an essential rigid connection, i.e. a mechanical hard connection. In this approach the receivers may be bolted directly together. In another approach the first and second receivers may be connected via a flexible connection, such as via a suspension member. The suspension member may prevent that vibrations being generated by one receiver reaches the other receiver, i.e. the suspension member may be applied as a vibration damping arrangement.

The first and second receivers may be essentially identical receivers. Thus, both the first and second receivers may comprise moving armature receivers, such as balanced armature receivers. However, the frequency responses of the two receivers may be different, for example by including a tweeter receiver and a woofer receiver in the receiver assembly. It should be noted that the first and second receivers may differ in other ways, such as size, shape, functionality, vibration properties and/or applied motor type.

The one or more microphone units of the receiver assembly may comprise MEMS microphones and/or electret microphones.

The receiver assembly may further comprise one or more vibration isolating spacers being arranged between the assembly housing and the first and second receivers. The one or more vibration isolating spacers may form a free-space region between the assembly housing and the first and second receivers. The one or more microphone units may advantageous be, at least partly, arranged in the free-space region between the assembly housing and the first and second receivers.

In a second aspect the present invention relates to an acoustical assembly comprising an assembly housing, a receiver module, and one or more spacers being arranged between the assembly housing and the receiver module, the one or more spacers forming a free-space region between the assembly housing and the receiver module.

Thus, the second aspect of the present invention relates to an acoustical assembly where the receiver module is arranged in a box-in-a-box configuration with an assembly housing. The receiver module may comprise a single receiver, i.e. one receiver. Alternatively, the receiver module may comprise a receiver assembly according to the first aspect.

The one or more microphone units may be at least partly positioned in the free-space region between the assembly housing and the receiver module. It is a space saving, and thereby advantageous feature, that the one or more microphones units may be positioned in the free-space region being provided by the one or more spacers.

The one or more spacers may comprise one or more vibration isolating elements in order to vibration isolate the assembly housing from the receiver module. As previously addressed the one or more microphone units may comprise MEMS microphones and/or electret microphones.

In a third aspect the present invention relates to a hearing device comprising an acoustical assembly according to the second aspect, said hearing device comprising a hearing aid being selected from the group consisting of: behind-the-ear, in-the-ear, in-the-canal and completely-in-the-canal.

BRIEF DESCRIPTION OF THE DRAWINGS

The present invention will now be described in further details with reference to the accompanying figures, wherein.

Figure 1:
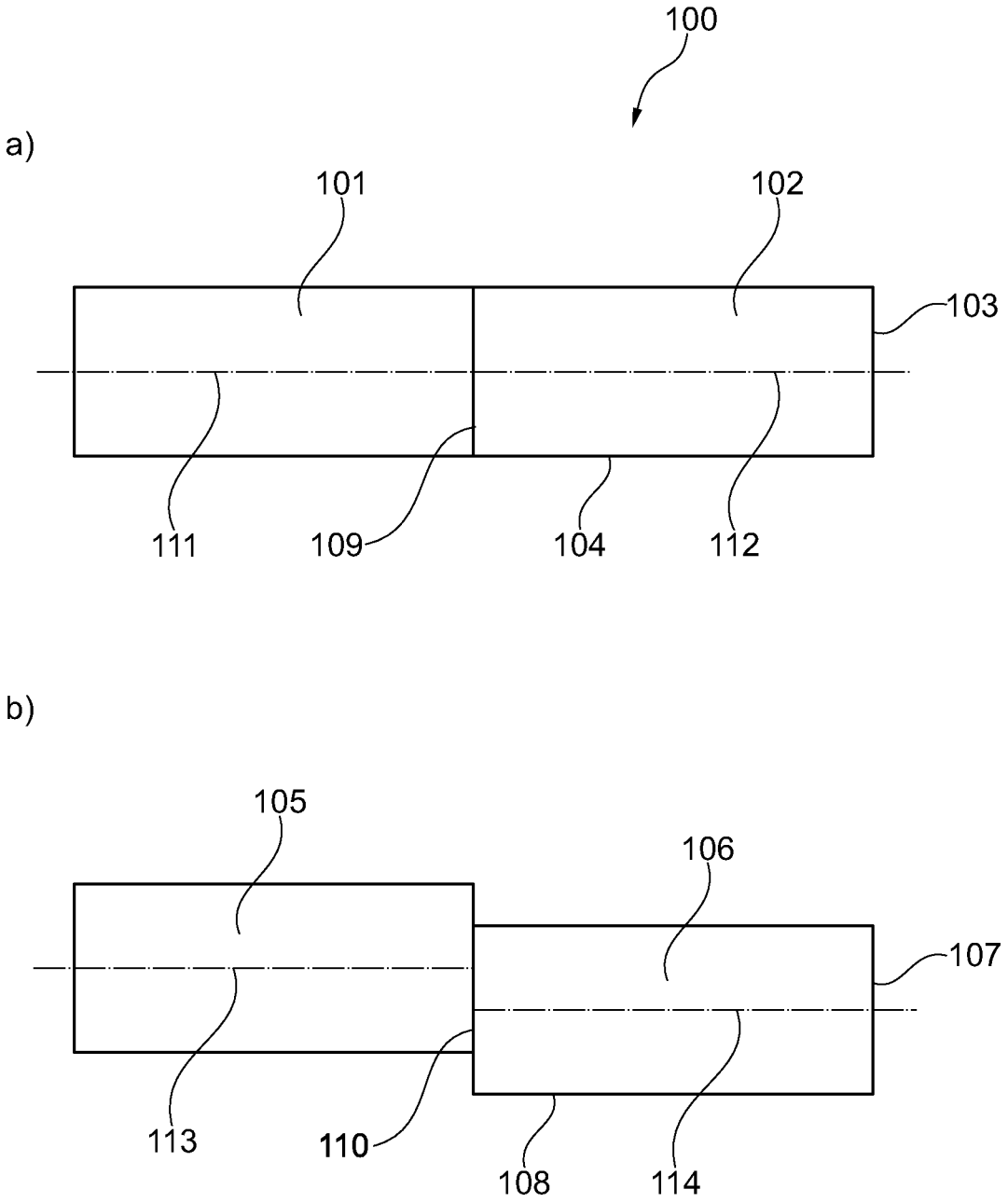
FIG. 1 shows rigidly connected receivers in an in-line configuration and a shifted configuration.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a receiver assembly that via its elongated shape fits into a human ear canal. The receiver assembly of the present invention is therefore suitable for forming part of a hearing device, such as a hearing aid.

Generally, the receiver assembly of the present invention comprises a plurality of receivers which may be either identical receivers or different receivers. For example, different receivers may be applied in a woofer/tweeter receiver configuration. The type and thereby functioning of the receivers may be different as well. Thus, armature receivers, moving coil receivers and electrostatic receivers may be combined to comply with certain demands.

On order to fit within the human ear canal, i.e. follow the internal shape of the human ear canal, the plurality of receivers are arranged in an in-line, or nearly in-line, configuration. By in-line is meant that the plurality of receivers are arranged in continuation of each other. It should be noted however, that the plurality of receivers may be slightly angled and spatially shifted relative to each other. With the configuration of the present invention the receiver assembly will take an essential elongated shape although the receivers may be slightly angled and/or spatially shifted relative to each other.

The plurality of receivers may be mutually connected by various means. Thus, the receivers may be mutually connected via a mechanically rigid connection, a flexible connection or a combination thereof. A flexible connection typically involves a membrane structure.

A receiver assembly can be provided as a box-in-box configuration where the receiver assembly is arranged inside an outer housing. Vibration suspensions may be provided between the receiver assembly and the outer housing in order to vibration isolate the two from each other. To effectively utilize the region between the receiver assembly and the outer housing one or more microphones may be arranged in that region.

Referring now to FIG. 1 a receiver assembly 100 comprising two elongated receivers 101, 102 is depicted. The two receivers 101, 102 are elongated in the sense that they both have a length 104 which is significantly longer than the width 103. Longitudinal centre lines 111, 112 are associated with each of the two receivers 101, 102, respectively. As seen in FIG. 1*a* the elongated receivers 101, 102 are connected in an in-line configuration with coinciding centre lines 111, 112 and a mechanically rigid connection 109. The in-line configuration of the two receivers 101, 102 ensures that the receiver assembly as a whole has an elongated shape. This is advantageous in that the receiver assembly then fits into the ear-canal of a human being.

In FIG. 1*b* two elongated receivers 105, 106 are spatially shifted in a direction being essentially perpendicular to the longitudinal centre lines 113, 114. However, the receiver assembly still forms an elongated receiver assembly. As depicted in FIG. 1*b* the respective longitudinal centre lines 113, 114 are not coinciding. However, the centre lines 113, 114 are still essentially parallel. Similar to the receivers of FIG. 1*a* the receivers 105, 106 have an elongated shape by having a length 108 which is significantly longer than the width 107. The receivers 105, 106 are connected via a mechanically rigid connection 110.

As previously addressed the elongated receivers may be identical receivers or different receivers. Moreover, the type and thereby functioning of the receivers may be different. Thus, armature receivers, moving coil receivers and electrostatic receivers may be combined to comply with certain audio demands. It should also be noted that the receiver assembly may involve more than two receivers.

Figure 2:
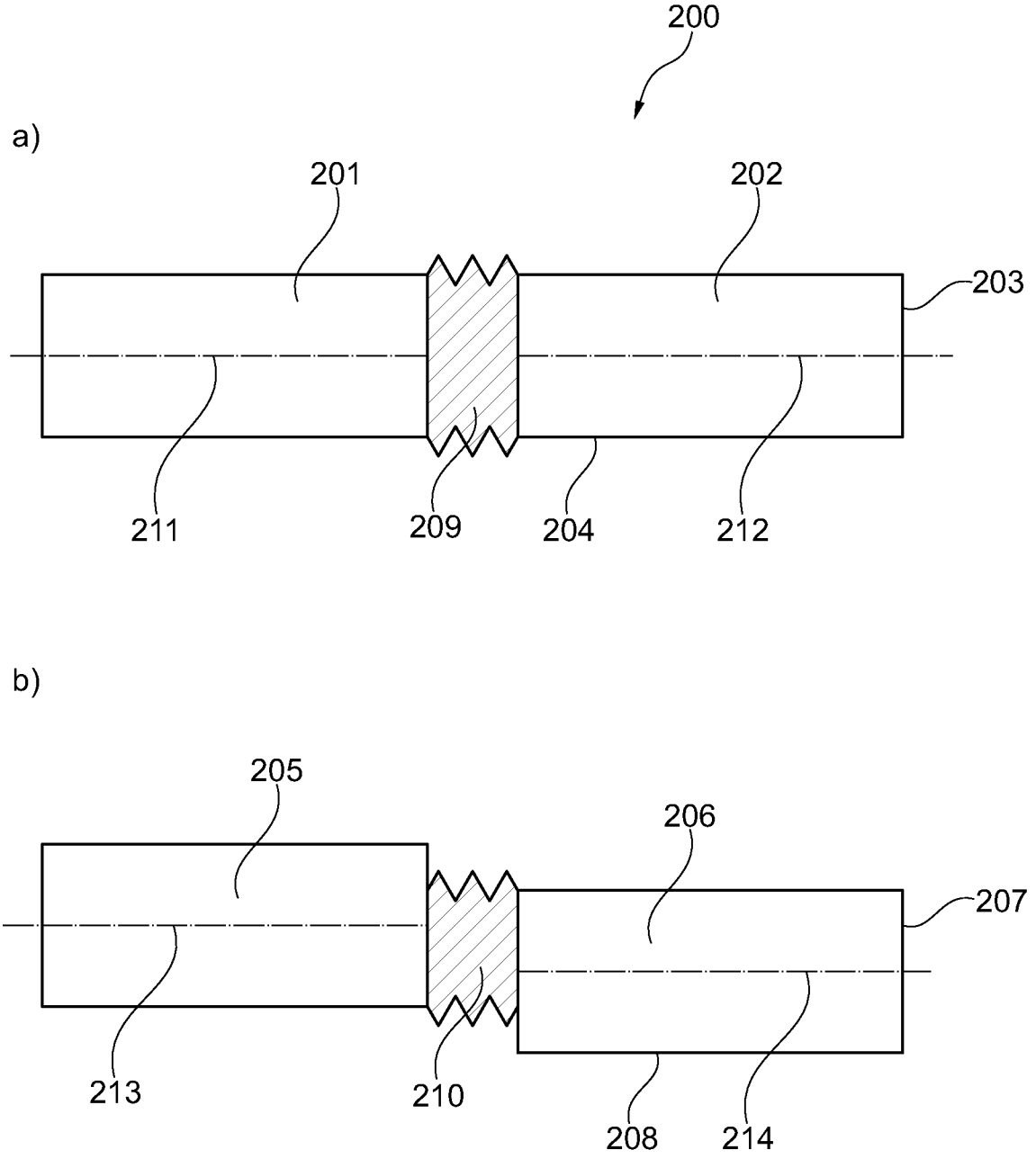
FIG. 2 shows flexible connected receivers in an in-line configuration and a shifted configuration.

FIG. 2 shows receiver configurations similar to those depicted in FIG. 1. However, instead of being connected via a mechanically rigid connection the receivers of FIG. 2 are connected via a flexible, and thereby a vibration isolating, arrangement. FIG. 2*a* shows an in-line configuration 200 involving two elongated receivers 201, 202 with coinciding centre lines 211, 212. A flexible connection arrangement 209 connects the two elongated receivers 201, 202. Again, the receivers 201, 202 have an elongated shape by having a length 204 which is significantly longer than the width 203.

FIG. 2*b* shows a pair of spatially shifted receivers 205, 206 where the respective centre lines 213, 214 are off-set relative to each other. Despite being spatially shifted in a direction being essentially perpendicular to the centre lines 213, 214, said centre lines 213, 214 remain essentially parallel. A flexible connection arrangement 210 connects the two elongated receivers 205, 206.

In the configurations depicted in FIGS. 2*a* and 2*b* the role of the flexible connection arrangements 209, 210 is to vibration isolate the elongated receivers from each other. The flexible connection arrangements 209, 210 can be implemented in various ways, such as by applying a membrane structure. The membrane structure will ensure that receiver generated vibrations from one elongated receiver are prevented from reaching and thereby influencing the performance of another receiver of the assembly. Again, the elongated receivers may be identical or different types of receivers.

Figure 3:
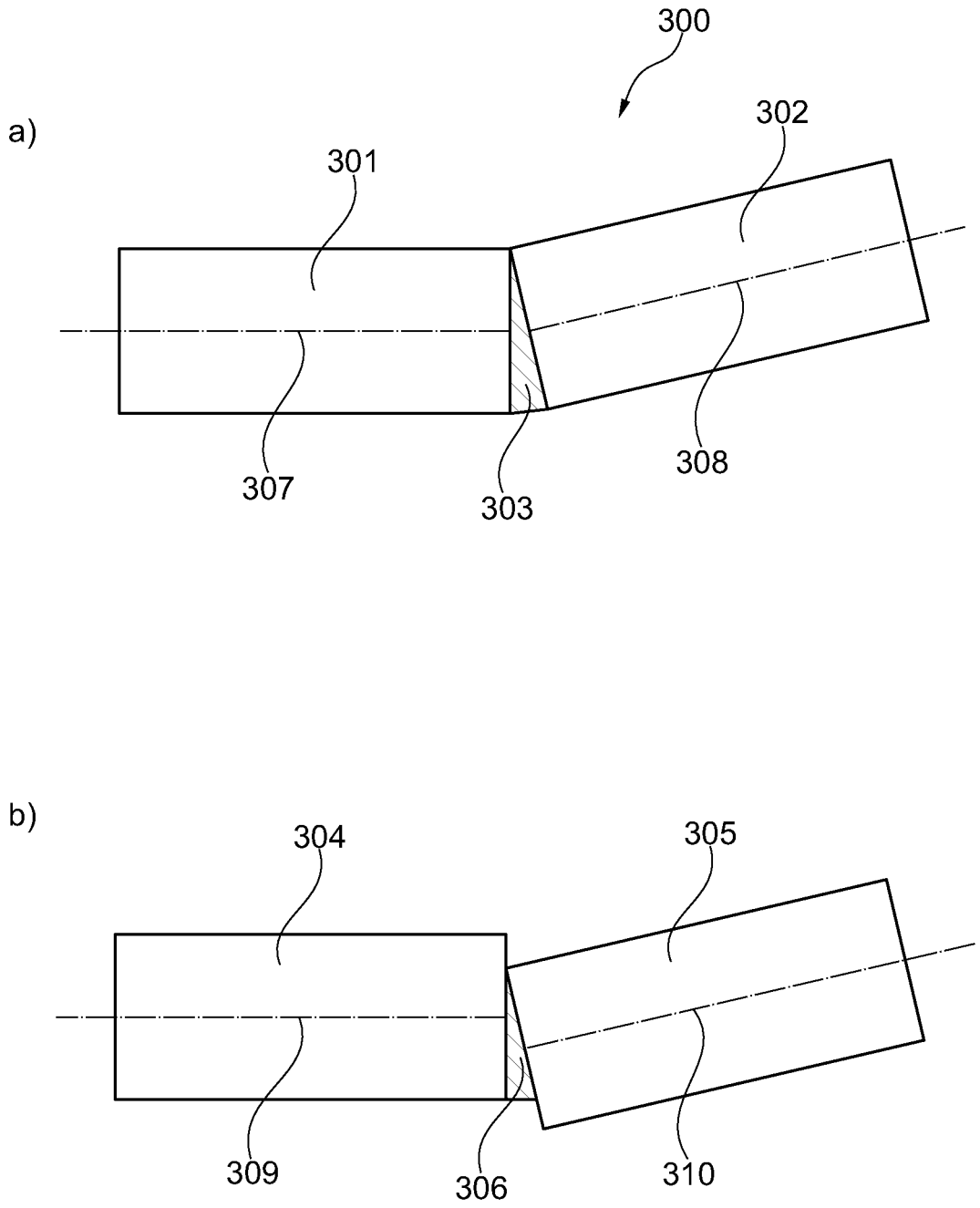
FIG. 3 shows angled receiver configurations.

Referring now to FIG. 3 a receiver assembly 300 with angled receivers 301, 302 is depicted. As illustrated in FIG. 3*a* the longitudinal centre lines 307, 308 form an angle relative to each other. This angled is defined by the wedge-shaped connection arrangement 303 being positioned between the elongated receivers 301, 302. The wedge-shaped may form a mechanically rigid connection or a flexible, and thereby vibration isolating connection. The two elongated receivers 301, 302 may be angled 5-45 degrees, such as 5-40 degrees, such as 5-35 degrees, such as 5-30 degrees, such as 5-25 degrees, such as 5-20 degrees, such as 5-15 degrees, such as 5-10 degrees relative to each other. Despite this angling the receiver assembly still defines an elongated structure being suitable for being positioned in an ear-canal of a human being. FIG. 3*b* shows a configuration where the two elongated receivers 304, 305 are angled and spatially shifted relative to each other. Similar to FIG. 3*a* the angling in FIG. 3*b* is defined by the wedge-shaped connection arrangement 306 which may be a mechanically rigid connection or a flexible, and thereby vibration isolating connection.

Figure 4:
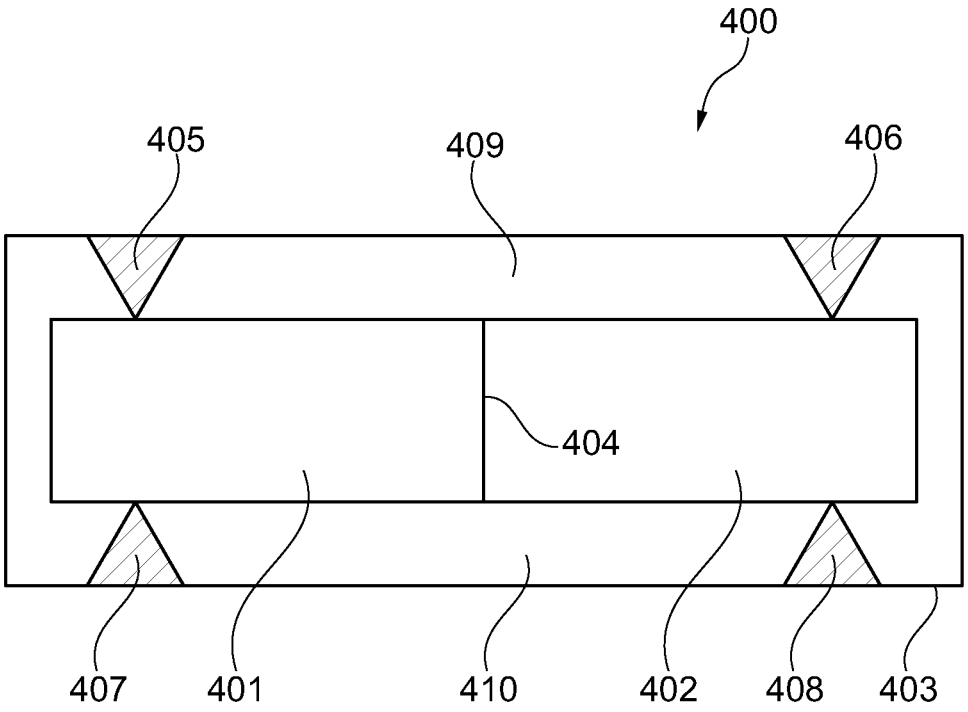
FIG. 4 shows a box-in-a-box configuration.

Referring now to FIG. 4 a box-in-a-box arrangement 400 is depicted. As seen in FIG. 4 an elongated receiver assembly comprising two connected receivers 401, 403 is positioned inside an outer housing 403. The two elongated receivers 401, 402 are connected via connection 404 which may be a mechanically rigid connection or a flexible, and thereby vibration isolating connection. In FIG. 4 the elongated receivers 401, 402 are connected in an in-line configuration. It should be noted however that the receivers 401, 402 could be angled and/or shifted as well without departing from the box-in-a-box arrangement depicted in FIG. 4. The box-in-a-box arrangement 400 depicted in FIG. 4 is a vibration isolated arrangements where the receiver assembly is vibration isolated from the outer housing 403 via suspension members 405, 406, 407, 408. Thus, receiver generated vibrations originating from one of the receivers 401, 402 are prevented from reaching the outer housing 403 due to the suspension of the receiver assembly inside the outer housing. As illustrated in FIG. 4 the presence of the suspension members 405, 406, 407, 408 between the receiver assembly and the outer housing 403 provide available free space regions 409, 410 between the receiver assembly and the outer housing 403.

It should be noted that instead of a receiver assembly involving two connected receivers 401, 402 a single receiver may be arranged within the outer housing 403.

Figure 5:
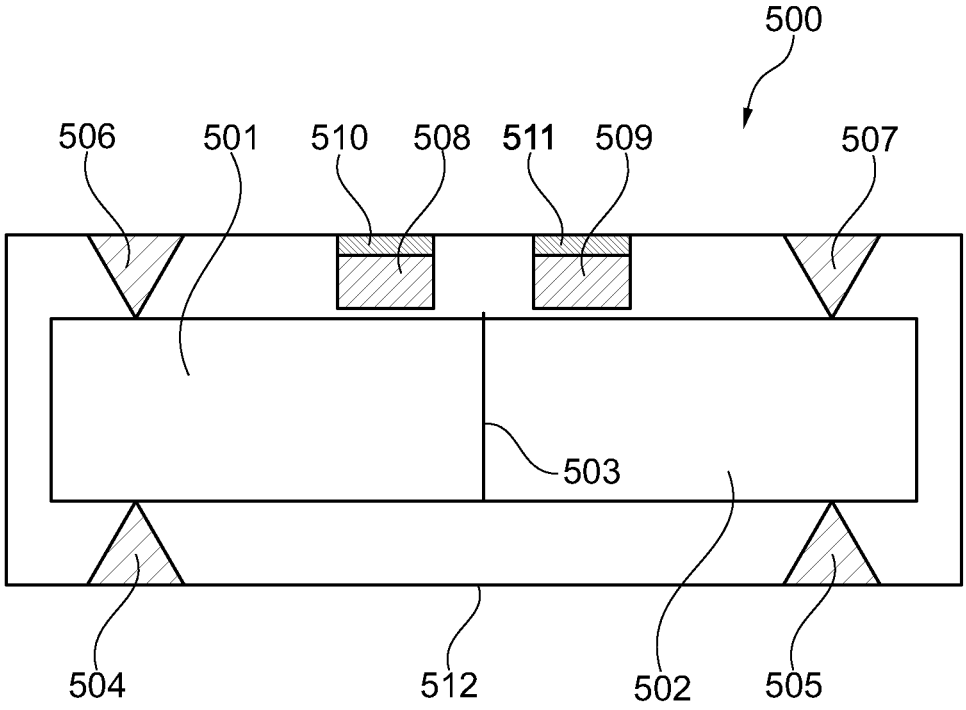
FIG. 5 shows a box-in-a-box configuration with microphone units.

Referring now to FIG. 5 two microphone units 508, 509 are secured to the outer housing 512 via connections 510, 511, respectively. Similar to FIG. 4, the box-in-a-box arrangement shown in FIG. 5 comprises a receiver assembly involving two connected receivers 501, 502. The receivers 501, 502 and connected via connection 503 which may be a mechanically rigid connection or a flexible, and thereby vibration isolating connection. Suspension members 504, 505, 506, 507 are provided for vibration isolation of the receiver assembly from the outer housing 512. In FIG. 5 the suspension members 504, 505, 506, 507 are positioned above and below the receiver assembly. Alternatively or in combination therewith the suspension members 504, 505, 506, 507 could be positioned on the sides of the receiver assembly. The microphone units 508, 509 may be MEMS microphones and/or electret microphones and the connections 510, 511 may be mechanically rigid connections or vibration isolating connections. In FIG. 5 the microphone units 508, 509 are positioned above the receiver assembly. Other suitable positions for the microphone units 508, 509 are for example below the receiver assembly. Sound inlet openings (not shown) are provided in the outer housing 512 so that incoming sound is able to reach the microphone units 508, 509.

Again, it should be noted that instead of a receiver assembly involving two connected receivers 501, 502 a single receiver may be arranged within the outer housing 512.

As previously mentioned the receiver assembly of the present invention may comprise two or even more receivers. These receivers may be identical receivers or different receivers. In case of using two identical receivers in an in-line configuration receiver generated vibrations tend to cancel out. Two identical receivers may be oriented in the manner, i.e. with the motor and membrane moving in essentially the same direction. Alternatively, two identical receivers may be oriented in an opposite manner, i.e. with the motor and membrane moving in essential opposite directions.

In case of different receivers, for example a tweeter/woofer configuration, a desired or even an enhanced acoustical performance may be obtained. In addition to the different frequency response the receivers may be different in terms size, shape, functionality, vibration properties and/or applied motor type. In case of a box-in-a-box configuration different receivers may be suspended differently. For example, in the before mentioned tweeter/woofer configuration the woofer will typically not be suspended. Moreover, the orientation of the woofer is not critical from a vibration perspective. The tweeter however will often be suspended in a vibration isolating suspension arrangement.

Figure 7:
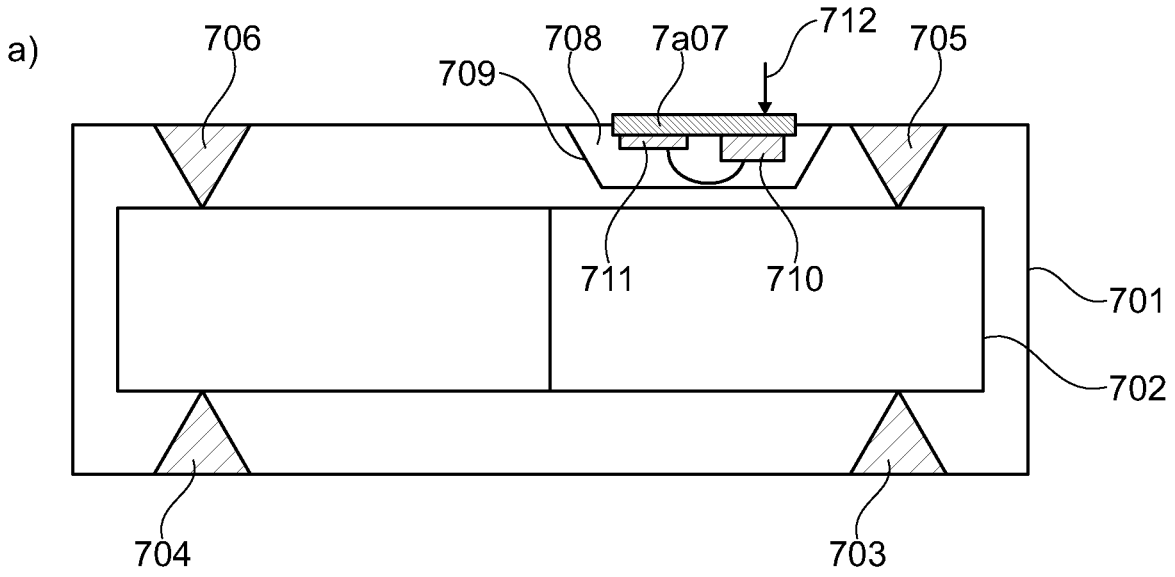
FIG. 7 shows a box-in-a-box configuration with a single microphone unit and two microphones units with closed and separated back volumes.
Figure 7:
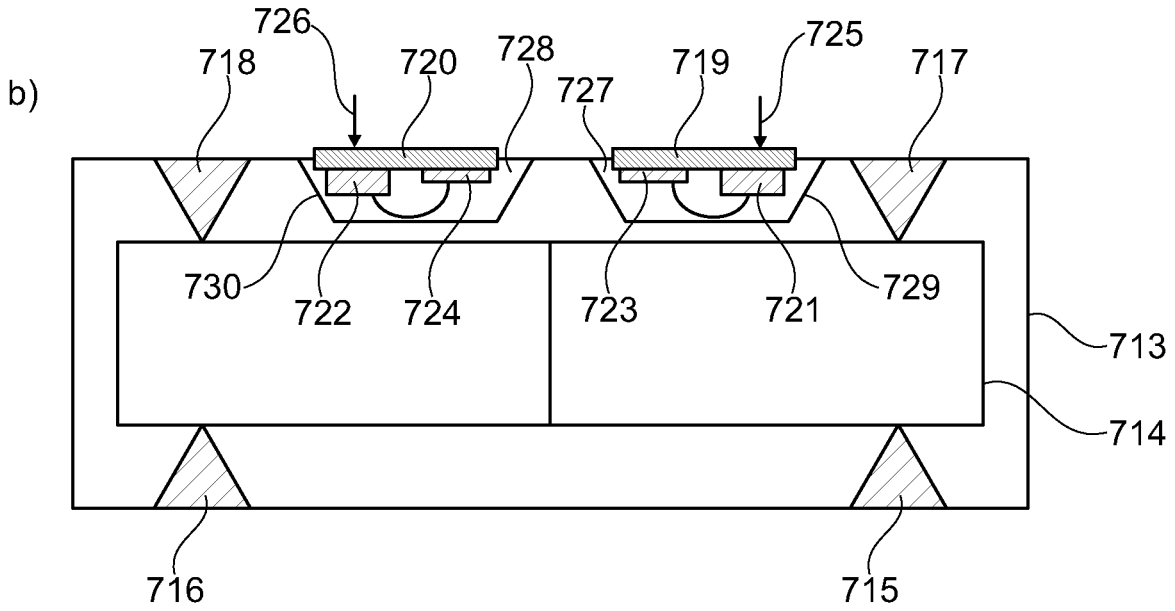
Figure 8:
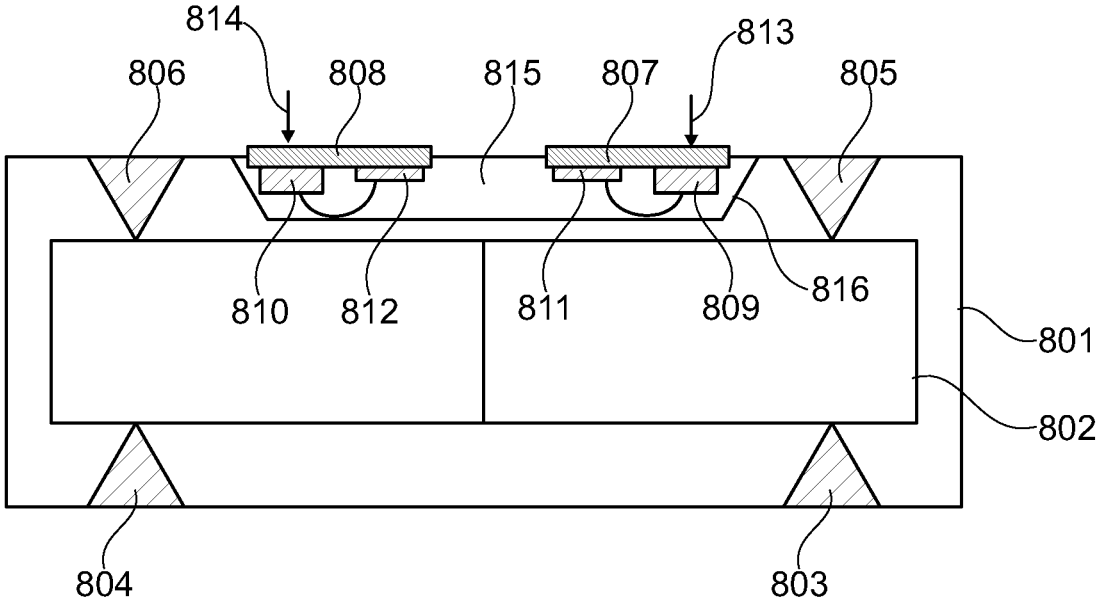
FIG. 8 shows a box-in-a-box configuration with two microphones units with a shared back volume.

Regarding the microphone units one or more microphone units may be applied in relation to the box-in-a-box configuration. As already mentioned the microphone units may be MEMS microphones and/or electret microphones with either open or closed rear volumes, cf. FIGS. 6*a* and 7*a*. In case of two microphone units these may have an open rear volume (FIG. 6*b*), have separate rear volumes (FIG. 7*b*) or share a closed rear volume (FIG. 8).

Figure 6:
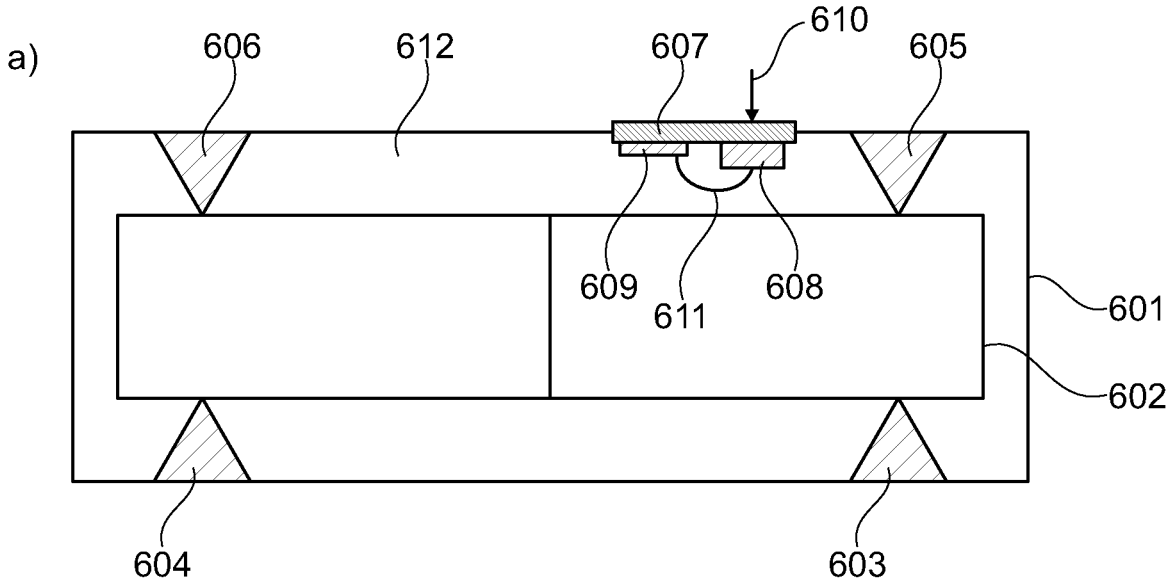
FIG. 6 shows a box-in-a-box configuration with a single microphone unit and two microphones units with open back volumes.
Figure 6:
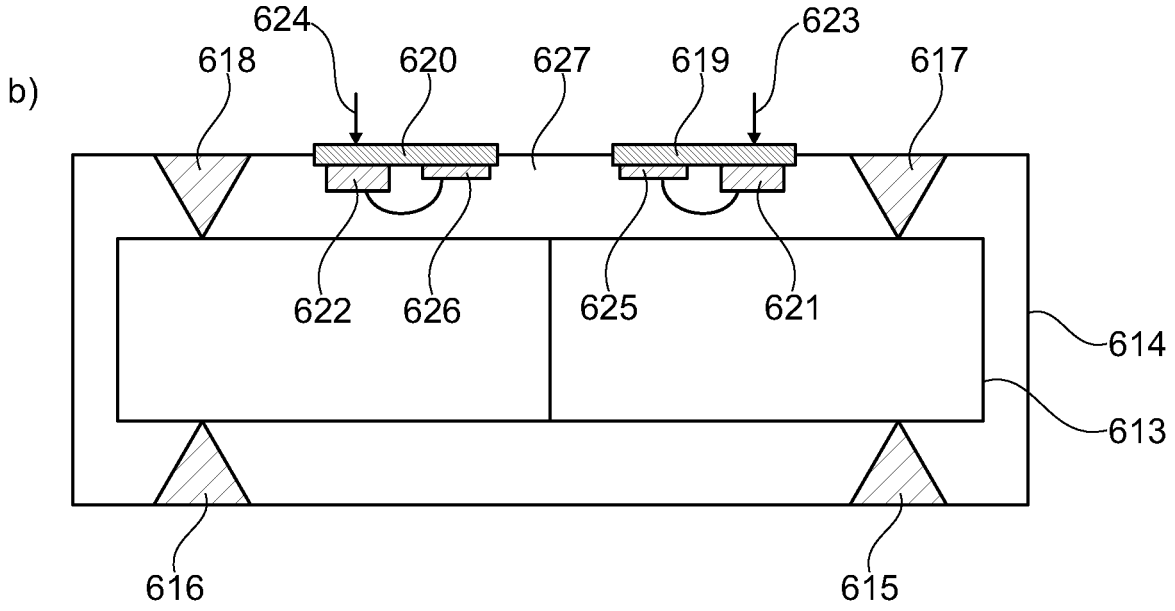

Referring now to FIG. 6*a* a box-in-a-box configuration is depicted. As seen in FIG. 6*a* a receiver assembly 602 is arranged within an outer housing 601. The receiver assembly 602 and the outer housing 601 are vibration isolated from each other via four suspension members 603-606. A single MEMS microphone unit 607 comprising a MEMS microphone 608 having a sound inlet (indicated by arrow 610) and a signal processing circuit 609 is secured to or integrated with the outer housing 601. The MEMS microphone 608 and the signal processing circuit 609 are connected via an electrical connection 611, such as a wire. The MEMS microphone unit 607 has an open rear volume 612.

FIG. 6*b* also depicts a box-in-a-box configuration. As seen in FIG. 6*b* a receiver assembly 613 is arranged within an outer housing 614. Again, the receiver assembly 613 and the outer housing 614 are vibration isolated from each other via four suspension members 615-618. Two MEMS microphone units 619, 620 each comprising a MEMS microphone 621, 622 having a sound inlet (indicated by arrows 623, 624) and a signal processing circuit 625, 626 are secured to or integrated with the outer housing 614. Again, electrical wires connect the MEMS microphones and the signal processing circuits.

Both the single MEMS microphone unit of 607 FIG. 6*a* and the two MEMS microphone units 619, 620 of FIG. 6*b* have open rear volumes 612, 627.

In FIG. 7*a* a single MEMS microphone unit 707 having a closed rear volume 708 is depicted. The closed rear volume 708 is defined by the separation wall 709. The MEMS microphone unit 707 comprises a MEMS microphone 710 having a sound inlet as indicated by arrow 712 and a signal processing circuit 711. Generally, FIG. 7*a* depicts a box-in-a-box configuration with a receiver assembly 702 arranged within an outer housing 701 in a vibration isolating arrangement via suspension elements 703-706.

FIG. 7*b* shows two MEMS microphone units 719, 720 each having a closed rear volume 727, 728. The closed rear volumes 727, 728 are defined by the respective separation walls 729, 730. Each of the MEMS microphone units 719, 720 comprises a MEMS microphone 721, 722 having a sound inlet as indicated by arrows 725, 726 and a signal processing circuit 723, 724. Similar to FIG. 7*a*, FIG. 7*b* depicts a box-in-a-box configuration with a receiver assembly 714 arranged within an outer housing 713 in a vibration isolating arrangement via suspension elements 715-718.

FIG. 8 shows two MEMS microphone units 807, 808 sharing a closed rear volume 815. The shared closed rear volume is defined by the separation wall 816. Each of the MEMS microphone units 807, 808 comprises a MEMS microphone 809, 810 having a sound inlet as indicated by arrows 813, 814 and a signal processing circuit 811, 812. Similar to FIG. 7, FIG. 8 depicts a box-in-a-box configuration with a receiver assembly 802 arranged within an outer housing 801 in a vibration isolating arrangement including suspension elements 803-806.

The invention claimed is:

1. A receiver assembly comprising a first receiver having a distinct longitudinal direction and a first longitudinal centre line, a second receiver having a distinct longitudinal direction and a second longitudinal centre line, and one or more microphone units for receiving incoming sound, wherein the distinct longitudinal directions of the first and second receivers are arranged essentially parallel to a distinct longitudinal direction of the receiver assembly, and wherein the first receiver, the second receiver and the one or more microphone units are at least partly arranged within an assembly housing, and wherein each of the first and second receivers is elongated such that a length thereof is longer than a corresponding width thereof, wherein the distinct longitudinal direction of each of the first and second receivers extends along the length thereof, and wherein the first and second receivers are arranged side by side such that each of their respective lengths extends essentially parallel to the distinct longitudinal direction of the receiver assembly.

2. A receiver assembly according to claim 1, wherein the first and second receivers are arranged with essentially parallel first and second longitudinal centre lines.

3. A receiver assembly according to claim 2, wherein the first and second receivers are spatially shifted in a direction being essentially perpendicular to first and second longitudinal centre lines.

4. A receiver assembly according to claim 2, wherein the first and second receivers are arranged in an in-line configuration with essentially coinciding first and second longitudinal centre lines.

5. A receiver assembly according to claim 1, wherein the first and second receivers are arranged with their respective moving directions in essentially opposite directions in order to reduce vibrations.

6. A receiver assembly according to claim 1, wherein the first and second receivers are arranged with their respective moving directions in essentially parallel directions.

7. A receiver assembly according to claim 1, wherein the first and second receivers are arranged with angled first and second longitudinal centre lines.

8. A receiver assembly according to claim 7, wherein the first and second receivers are arranged with an angle of 5-45 degrees or an angle of 5-25 degrees or an angle of 5-10 degrees between the first and second longitudinal centre lines.

9. A receiver assembly according to claim 1, wherein the first and second receivers are connected via an essential rigid connection.

10. A receiver assembly according to claim 1, wherein the first and second receivers are connected via a flexible connection.

11. A receiver assembly according to claim 10, wherein the first and second receivers are connected via a suspension member.

12. A receiver assembly according to claim 1, wherein the first and second receivers are essentially identical receivers.

13. A receiver assembly according to claim 1, wherein the first and second receivers comprise moving armature receivers.

14. A receiver assembly according to claim 13, wherein the first and second receivers comprise balanced armature receivers.

15. A receiver assembly according to claim 1, wherein the one or more microphone units comprise one or more MEMS microphones or one or more electret microphones.

16. A receiver assembly according to claim 1, further comprising one or more vibration isolating spacers being arranged between the assembly housing and the first and second receivers.

17. A receiver assembly according to claim 16, wherein the one or more vibration isolating spacers form a free-space region between the assembly housing and the first and second receivers.

18. A receiver assembly according to claim 17, wherein the one or more microphone units are at least partly arranged in the free-space region between the assembly housing and the first and second receivers.

19. A hearing device comprising a receiver assembly according to claim 1, said hearing device comprising a behind-the-ear hearing aid or an in-the-ear hearing aid or an in-the-canal hearing aid or a completely-in-the-canal hearing aid.

* * * * *